US005824420A

United States Patent [19]

Dobashi et al.

[11] Patent Number: 5,824,420

[45] Date of Patent: Oct. 20, 1998

[54] INTERMEDIATE TRANSFER MEMBER FOR THERMAL TRANSFER PRINTER

[75] Inventors: Koichi Dobashi; Isao Ohwada, both of Iwate-ken; Hiroyoshi Zama, Iwate-ken; Makoto Sato; Noboru Shimamoto, both of Gunma-ken, all of Japan

[73] Assignee: Alps Electronic Co., Ltd., Japan

[21] Appl. No.: 539,095

[22] Filed: Oct. 4, 1995

[30] Foreign Application Priority Data

Oct. 4, 1994 [JP] Japan ..... 6-240262
Apr. 7, 1995 [JP] Japan ..... 7-082517

[51] Int. Cl.[6] ..... B41M 5/40

[52] U.S. Cl. ..... 428/447; 156/235; 428/195; 428/209; 428/913; 428/914; 428/35.7

[58] Field of Search ..... 428/195, 447, 428/913, 914, 35.7; 8/471; 503/227; 156/235

[56] References Cited

FOREIGN PATENT DOCUMENTS 5-338368 12/1993 Japan ..... 503/227

*Primary Examiner*—Bruce H. Hess

*Attorney, Agent, or Firm*—Brinks Hofer Gilson & Lione

[57] ABSTRACT

An intermediate transfer member for a thermal transfer printer adapted to an intermediate transfer method and comprising: an intermediate transfer member, which has a transfer layer, and on which an ink image is written by thermal transfer; and a printing medium onto which the ink image written on the intermediate transfer member is again transferred, wherein material of at least a surface layer of the transfer layer is silicon rubber containing: (a) alkenyl-group-containing organopolysiloxane; (b) organohydrogenpolysiloxane (c) non-reactive organopolysiloxane expressed by the following formula (1):

$$R^1-(SiO)_n-\underset{R^2}{\overset{R^2}{Si}}-R^1 \quad (1)$$

where $R^1$ is a monovalent hydrocarbon group having no aliphatic unsaturated group or a hydroxyl group, $R^2$ are the same or different groups, such as methyl groups and phenyl groups, and 1 mol % to 30 mol % of all of $R^2$ in each molecule are phenyl groups; and (d) a hydrosilylated reactive catalyst, the silicon rubber containing no inorganic filler.

20 Claims, 3 Drawing Sheets

INTERMEDIATE TRANSFER MEMBER FOR THERMAL TRANSFER PRINTER

BACKGROUND OF THE INVENTION

1. Field of the Invention

The present invention relates to an intermediate transfer member for a thermal transfer printer that is capable of attaining excellent image quality while quickly recording an image onto plain paper or bond paper.

2. Description of the Prior Art

In general, conventional thermal transfer printers comprise a thermal head that melts ink on an ink ribbon so as to transfer the molten ink to form an image on a printing medium, such as paper.

To print an image by the usual thermal transfer printer with excellent image quality, an exclusive printing medium having smooth surfaces has been employed.

To print an image on a low-cost printing medium having large concavities and convexities, such as plain paper or bond paper, while preventing generation of defects, such as voids, thermal transfer printers adapted to an intermediate transfer method have been suggested in recent years, which comprises the steps of: temporarily and thermally transferring and recording ink, placed on an ink ribbon and melted due to heat generated by a thermal head, onto a roll- or a belt-shape intermediate transfer member having the surface made of silicon rubber or the like so as to write an ink image (a primarily recorded image) on to an intermediate transfer member; and again transferring the ink image written on the intermediate transfer member on to a printing medium.

The intermediate transfer member for use in the intermediate-transfer-type thermal transfer printer must have an excellent ink writing characteristic, required at the time of a recording process for writing an ink image, and a re-transferring characteristic, required at the time of again transferring the ink image onto the printing medium. In particular, the intermediate transfer member must have the surface that exhibits excellent releasability at the time of the re-transferring process.

A conventional intermediate transfer member capable of satisfying the foregoing requirement has been suggested in Japanese Patent Laid-Open No. 5-338368, in which the releasability of the silicon rubber is improved by adding, to the silicon rubber, dimethyl silicon oil, reactive silicon oil, such as amino- or epoxy- denatured silicon oil, or carnauba-denatured silicon oil that is in a solid form at 100° C. or lower.

The conventional intermediate transfer member comprising the silicon rubber, to which the foregoing releasing agent is added, is able to improve the releasability with respect to the ink as compared with the intermediate transfer member of a type that comprises a usual silicon rubber so that it is able to print an image onto a printing medium, such as plain paper or bond paper, with high quality.

In general, the releasing agent of a type that is added for the purpose of improving the releasability forms a uniform releasable layer on the surface so that it exhibits a function of improving the releasability of a base (the silicon rubber).

However, in a case where the releasing agent, to be added to the silicon rubber, is dimethyl silicon oil, it can easily be introduced into the silicon rubber, which is the base. Thus, the foregoing releasing agent cannot easily bleed onto the surface layer and therefore it cannot easily form a uniform releasable layer. If the foregoing releasing agent is added in a large quantity, the strength of the base is deteriorated excessively.

In a case where the releasing agent, to be added to the silicon rubber, is the reactive silicon oil, such as amino- or epoxy-denatured silicon oil, the releasing agent easily reacts and combines with the silicon rubber, that is the base. Thus, the amount of releasing agent existing on the surface layer and contributing to the releasability is unsatisfactorily low to obtain the desired effect. Therefore, if it is added in a small quantity, a desired effect cannot be obtained. If the foregoing releasing agent is added in a large quantity, the strength of the base is deteriorated excessively.

In a case where the releasing agent, to be added to the silicon rubber, is a solid agent, the releasing agent exists on the surface layer in a dot configuration. Thus, a uniform releasable layer cannot be easily formed, and it cannot always bleed onto the surface layer to maintain the releasing effect, and excessive change takes place as the time passes.

It might be considered feasible to employ a method of externally applying a releasing agent to the silicon rubber during printing, in place of the foregoing method, for improving the releasability by causing the releasing agent to be contained until use. However, the foregoing case must use an apparatus for supplying the releasing agent, thus resulting in that the structure of the apparatus becomes too complicated. In the foregoing case, it is difficult to form a uniform releasable layer while maintaining the writing characteristic.

As described above, the intermediate transfer member having the transfer layer, in which the releasing agent, such as dimethyl silicon oil, reactive silicon oil, such as amino- or epoxy-denatured silicon oil, or carnauba-denatured silicon oil that is in a solid form at 100° C. or lower, is added to the silicon rubber thereof, has not satisfactory initial releasability and the releasability after time has passed. Thus, a high transferring pressure is required at the time of the re-transferring process, and therefore the body of the thermal transfer printer must be strong enough. As a result, the size and cost of the thermal transfer printer cannot easily be reduced.

SUMMARY OF THE INVENTION

In view of the foregoing, an object of the present invention is to provide an intermediate transfer member for a thermal transfer printer that is capable of, for a long time, maintaining an ink writing characteristic at the time of a recording process, in which an ink image is written, and a re-transferring characteristic at the time of a re-transferring process in which the ink image is again transferred onto a printing medium.

Other and further objects, features and advantages of the invention will be evident from the following detailed description of the preferred embodiments in conjunction with the attached drawings.

DESCRIPTION OF THE PREFERRED EMBODIMENTS

Preferred embodiments of the present invention will now be described with reference to the drawings.

Initially, a first embodiment of an intermediate transfer member for a thermal transfer printer according to the present invention will be described with reference to FIG. 1.

Figure 1:
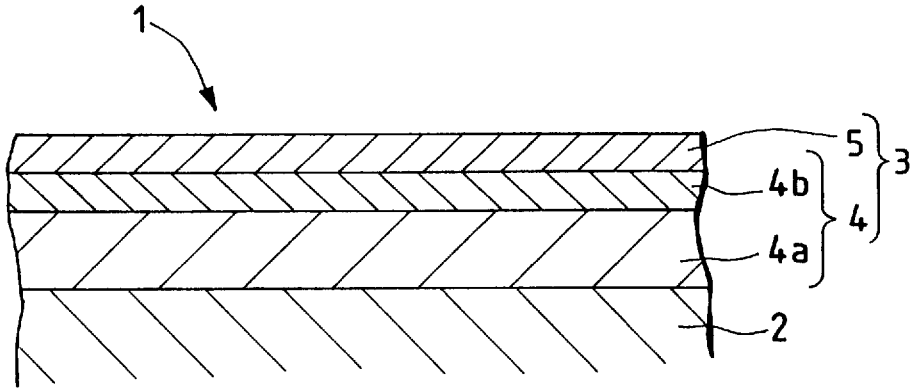
FIG. 1 is a schematic view showing a first embodiment of an intermediate transfer member for a thermal transfer printer according to the present invention.

FIG. 1 is a schematic view showing a first embodiment of the intermediate transfer member for the thermal transfer printer according to the present invention.

An intermediate transfer member 1 according to this embodiment is formed into a roll-like shape such that a metal roll 2 formed into a substantially cylindrical shape having an outer surface that is covered with a transfer layer 3 made of rubber. Experiments result in the optimum structure of the transfer layer 3 being obtained that comprises, as shown in FIG. 1, an intermediate elastic layer 4 and a surface elastic layer 5 formed in this sequential order when viewed from the outer surface of the metal roll 2, wherein the intermediate elastic layer 4 is in the form of a two-layer structure consisting of a first layer 4*a* and a second layer 4*b* formed in this sequential order when viewed from the outer surface of the metal roller 2 so that the transfer layer 3 is formed into a three-layer structure.

The first layer 4*a* of the intermediate elastic layer 4 is formed on the outer surface of the metal roll 2 so as to improve the adhesive properties of a thermal head, to be described later, with respect to the intermediate transfer member 1. Thus, ink can stably be transferred onto the intermediate transfer member 1, and the load can be made uniform at the time of the re-transferring process so that the re-transferring performance is improved. It is preferable that the first layer 4*a* be formed into an elastic member having a thickness of 0.1 mm to 2.8 mm and rubber hardness of 15 to 70 (JIS A), more preferably silicon rubber having a thickness of 1 mm and rubber hardness of 30 (JIS A).

The second layer 4*b* of the intermediate elastic layer 4 is formed on the outer surface of the first layer 4*a* of the intermediate elastic layer 4 so as to improve the smoothness of the transfer layer 3, and as well as to improve the characteristic to follow up the concavities and convexities of a printing medium 7, to be described later, so that the printing quality is improved. It is preferable that the second layer 4*b* be formed into an elastic member having a thickness of 5 $\mu$m to 200 $\mu$m and rubber hardness of 10 to 35 (JIS A), more preferably silicon rubber having a thickness of 100 $\mu$m and rubber hardness of 25 (JIS A) and containing no inorganic filler.

The surface elastic layer 5 must have an excellent ink writing characteristic at the time of the recording process in which an ink image is written on to the intermediate transfer member 1 and an excellent re-transferring characteristic at the time of the re-transferring process in which the ink image is again transferred on to the printing medium 7. In this embodiment, the surface elastic layer 5 is made of hardened silicon rubber comprising:

(a) Alkenyl-Group-Containing Organopolysiloxane 100 parts by weight of dimethylpolysiloxane, the viscosity of which is 400 cps at 25° C., and which has two terminals that are sealed by dimethylvinylsilyl groups;

(b) Organohydrogenpolysiloxane 2.2 parts by weight of organohydrogenpolysiloxane expressed by average composition formula (3) below:

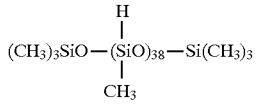

$$(CH_3)_3SiO-(\overset{H}{\underset{CH_3}{Si}}O)_{38}-Si(CH_3)_3 \quad (3)$$

(c) Non-Reactive Organopolysiloxane 1.0 part by weight of non-reactive organopolysiloxane, which is methylphenylpolysiloxane, the viscosity of which is 2000 cps at 25° C., which has two terminals that are sealed by trimethylsilyl groups, and which contains diphenylsiloxane units by 6 mol %; and (d) Hydrosilylated Reactive Catalyst 0.5 part by weight of 2 wt % alcohol solution of chloroplatinic acid, wherein no inorganic filler is contained. It is preferable that the silicon rubber be an elastic member having a thickness of 5 $\mu$m to 200 $\mu$m and rubber hardness of 38 (JIS A), more preferably a thickness of 30 $\mu$m.

In this embodiment, (a) alkenyl-group-containing organopolysiloxane has a structure expressed by unit constitutional formula —$R^6R^7$ SiO—, where $R^6$ and $R^7$ are each an alkyl group, such as a methyl group, an ethyl group or a propyl group, a 3, 3, 3-trifluoropropyl group in which fluorine atoms are substituted for a portion or all hydrogen atoms bonded to their carbon atoms, or an alkenyl group having 2 to 3 carbon atoms, such as a vinyl group or an allyl group. It is preferable that the methyl group or the vinyl group be employed. The terminals are exemplified by vinyl groups and trimethylsilyl groups. The viscosity of (a) alkenyl-group-containing organopolysiloxane is 100 cps to 100,000 cps at 25° C., more preferably 300 cps to 10,000 cps. Furthermore, it is preferable that (a) alkenyl-group-containing organopolysiloxane has two or more alkenyl groups in one molecule thereof.

In this embodiment, (b) organohydrogenpolysiloxane serves as a crosslinking agent with respect to component (a) alkenyl-group-containing organopolysiloxane. If two or more hydrogen atoms bonded to the silicon unit are contained in the molecule of the organohydrogenpolysiloxane, any special limit is not set. It is preferable that organohydrogenpolysiloxane having the structure expressed by formula (2) be employed:

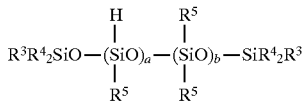

$$R^3R^4{}_2SiO-(\overset{H}{\underset{R^5}{Si}}O)_a-(\overset{R^5}{\underset{R^5}{Si}}O)_b-SiR^4{}_2R^3 \quad (2)$$

where $R^3$ is a hydrogen atom or a monovalent hydrocarbon group having no aliphatic unsaturated group, the monovalent hydrocarbon group being exemplified by an alkyl group, such as a methyl group, an ethyl group or a propyl group, or a 3, 3, 3-trifluoropropyl group in which fluorine atoms are substituted for a portion or all hydrogen atoms bonded to their carbon atoms, and $R^3$ preferably being a hydrogen atom or a methyl group, $R^4$ and R5 are each a monovalent hydrocarbon group having no aliphatic unsaturated group that is exemplified by the materials exemplified as $R^3$, and preferably a methyl group.

To cause component (b) to crosslink with component (a) to form a desired transfer layer, a is an integer not less than 3 and b is an integer not less than 0 in the foregoing formula (2). In order to improve the adhesive properties between the material forming the surface layer of the transfer layer and the intermediate elastic layer below the surface layer and to sufficiently improve the releasability with respect to ink, the crosslinking density must be raised, preferably a/(a+b) is 0.7 or more and 1.0 or less.

It is preferable that the foregoing (b) organohydrogenpolysiloxane usually has a viscosity of 1,000 cps or lower at 25°

C. It is preferable that quantity of blended (b) organohydrogenpolysiloxane be such that the number of hydrogen atoms bonded to silicon is at least one per one alkenyl group in component (a) alkenyl-group-containing organopolysiloxane. In particular, it is further preferable that the number of hydrogen atoms bonded to silicon is 1 to 5 per one alkenyl group.

In the present invention, (c) non-reactive organopolysiloxane is a characteristic component of the present invention and contributes to improvement in the releasability of the transfer layer with respect to ink, component (c) being expressed by formula (1) below:

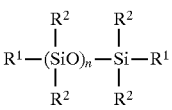

(1)

wherein the monovalent hydrocarbon group represented by $R^1$ and having no aliphatic unsaturated group is exemplified by the materials exemplified as $R^4$ and $R^5$ in the foregoing formula (2), preferably a methyl group, $R^2$ are the same or different groups, such as methyl groups and phenyl groups. 1 to 30 mol %, preferably 3 mol % to 15 mol % of all $R^2$ in (c) non-reactive organopolysiloxane must be phenyl groups. If the content of the phenyl groups is smaller than 1 mol %, the compatibility with (a) alkenyl-group-containing organopolysiloxane, which is the base polymer, is raised excessively, thus resulting in that component (c) can easily be introduced into the base polymer. Thus, it cannot easily bleed onto the surface layer of the transfer layer to form a uniform releasable layer.

If the content of the phenyl groups is larger than 30 mol %, the compatibility with (a) alkenyl-group-containing organopolysiloxane, which is the base polymer, is deteriorated excessively. As a result, bleeding onto the surface of the transfer layer takes place excessively, and thus problems arise in that the writing characteristic deteriorates, a uniform releasable layer cannot be formed, the releasability is changed excessively as time passes to maintain the stable releasability for a long time. By determining the content of the phenyl groups to be 1 mol % to 30 mol %, excessive bleeding of the releasing agent can be prevented, a uniform releasable layer can always be formed, and releasability satisfactory in viewpoints of initial characteristics and durability can be obtained.

Furthermore, it is preferable that the viscosity of (c) non-reactive organopolysiloxane be 100 cps to 100,000 cps, more preferably 300 cps to 10,000 cps to obtain satisfactory releasability.

If the viscosity is lower than 100 cps, the non-reactive organopolysiloxane can easily be introduced into the base and thus a desired releasing effect cannot easily be obtained. If the viscosity is higher than 100,000 cps, there arises a tendency that the releasable layer cannot easily be formed on the surface layer.

It is preferable that the quantity of addition of component (c) be 0.2 parts by weight to 10.0 parts by weight with respect to 100 parts by weight of component (a), more preferably 0.5 parts by weight to 3.0 parts by weight.

In this embodiment, (d) hydrosilylated reactive catalyst is a catalyst for promoting the addition reaction (hydrosilylation) between component (a) and component (b) and may be usually a platinum group metal catalyst, that is, a platinum, palladium or rhodium catalyst, which is known to the expert in this industrial field. In particular, a platinum group catalyst is used as a preferred catalyst. The platinum group catalyst is exemplified by platinum black, chloroplatinic acid and a complex of chloroplatinic acid and olefin, such as ethylene, alcohol, aldehyde, vinylsilane or vinylsiloxane.

The quantity of blending of (d) hydrosilylated reactive catalyst is usually 1 ppm to 500 ppm with respect to 100 parts by weight of component (a), preferably 5 ppm to 20 ppm.

It is necessary for the silicon rubber for use in the intermediate transfer member for the thermal transfer printer according to the present invention not to contain an inorganic filler, such as silica, that is usually blended into silicon rubber. If the inorganic filler is added to the silicon rubber, the releasability deteriorates excessively. Note that silicon resin may be added for the purpose of reinforcing the structure to a degree that does not deteriorate the releasability.

In a case where the transfer layer according to the present invention consists of n (n=1, 2) intermediate elastic layers made of rubber and the surface elastic layer, any of the following elastic materials may be employed to form the intermediate elastic layer: styrene rubber, ethylene-propylene rubber, urethane rubber and silicon rubber. Among the foregoing materials, it is preferable that silicon rubber be employed because it has excellent heat resistance and it does not deteriorate the releasability of the surface elastic layer.

The surface elastic layer can be formed by a known method, such as spray coating, dip coating or a knife coating.

By using the thus-structured intermediate transfer member 1 in a thermal transfer printer 8 to be described later, the ink writing characteristic at the time of the recording process, in which an ink image is written, and the re-transferring characteristic at the time of the re-transferring process, in which the ink image is again transferred onto the printing medium 7, can be maintained for a long time. Furthermore, an image having excellent quality can be formed on the printing medium 7, such as plain paper or bond paper.

A fact was found that use of the intermediate transfer member 1 according to this embodiment enables the load at the time of the re-transferring process to be reduced to 3 Kg/cm or less, and in this embodiment, to 2 Kg/cm or less. Since lowering of the pressure of the load at the time of the re-transferring process enables the size and the strength of the thermal transfer printer 8 to be reduced and weakened, the size and cost reductions of the thermal transfer printer 8 can reliably be achieved.

The thermal transfer printer 8 comprising the intermediate transfer member 1 according to this embodiment will now be described with reference to FIG. 2.

Figure 2:
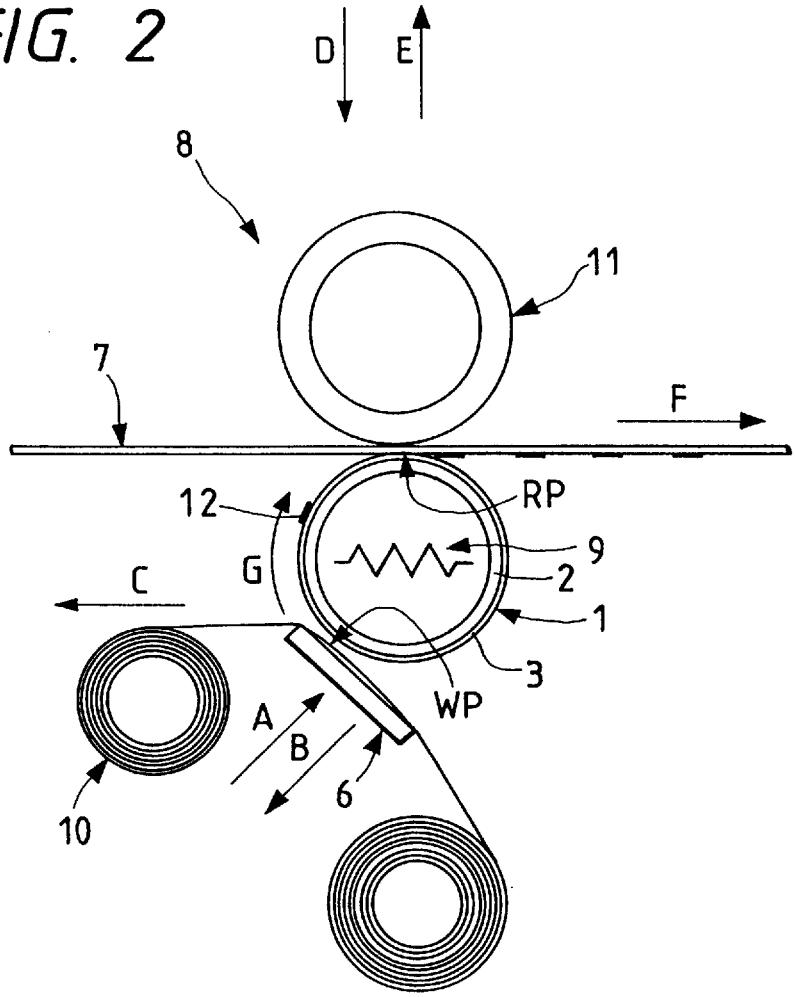
FIG. 2 is a diagram showing a thermal transfer printer having the intermediate transfer member for a thermal transfer printer according to the first embodiment of the present invention.

FIG. 2 is a diagram showing an essential portion of the structure of an embodiment of the thermal transfer printer 8 comprising the intermediate transfer member 1 for a thermal transfer printer according to a first embodiment of the present invention.

As shown in FIG. 2, the thermal transfer printer 8 according to this embodiment comprises the intermediate transfer member 1 (see FIG. 1) in the body thereof. The intermediate transfer member 1 has a function of a platen called a transfer platen formed into a cylindrical shape. The intermediate transfer member 1 can be rotated by a drive source (not shown), such as a stepping motor, that transmits drive force to the intermediate transfer member 1. The outer surface of the transfer layer 3 of the intermediate transfer member 1 is made smooth. The intermediate transfer member 1 includes a heater 9 for raising the temperature to a level required to write ink onto the intermediate transfer member 1 and required to re-transfer and fix the ink on to the printing medium 7, the heater 9 being controlled to make the temperature of the surface of the intermediate transfer member 1 to be about 50° C.

The metal roll forming the intermediate transfer member 1 may be formed into a cartridge heater comprising a heating wire embedded in a metal member thereof to form a structure in which the heater 9 is not disposed in the intermediate transfer member 1.

A thermal head 6 is disposed at a lower left position when viewed from the intermediate transfer member 1. The thermal head 6 can be, by a drive mechanism (not shown), brought into contact with the intermediate transfer member 1 and moved away from the same as indicated by arrows A and B shown in FIG. 2. The thermal head 6 comprises a plurality of heating devices (not shown) that selectively generate heat in accordance with information about an image to be printed. The position, at which the thermal head 6 and the intermediate transfer member 1 are brought into contact with each other, is determined to be transferring position WP at which ink on an ink ribbon 10 is written on to the intermediate transfer member 1.

Between the intermediate transfer member 1 and the thermal head 6, there is supplied the ink ribbon 10. The ink ribbon 10 is, as indicated by an arrow C shown in FIG. 2, moved from a lower position toward an upper right position so that the ink ribbon 10 is sequentially wound toward the left portion when viewed in FIG. 2. The ink ribbon 10, which faces the intermediate transfer member 1 at the transferring position WP, has a desired thermal fusible ink (not shown) on the surface thereof.

Above the intermediate transfer member 1, there is disposed a rotative pressure roller 11 comprising a metal roll made of a metal material and formed into a substantially cylindrical shape. The pressure roller 11 can be, by a drive mechanism (not shown), moved vertically as indicated by arrows D and E shown in FIG. 2 so as to be brought into contact with the intermediate transfer member 1 and moved away from the same. The position, at which the pressure roller 11 and the intermediate transfer member 1 are brought into contact with each other, is re-transferring position RP at which an ink image 12 is again transferred to the printing medium 7.

Note that the pressure roller 11 may be formed into a structure including a heater or a structure in which the outer surface of a metal roll having a circular cross sectional shape is covered with rubber. The structure of the pressure roller 11 is not limited to that according to this embodiment.

Between the intermediate transfer member 1 and the pressure roller 11, there is supplied (fed) the printing medium 7, such as plain paper, bond paper or an OHP sheet. The printing medium 7 is, as indicated by an arrow F shown in FIG. 2, supplied from a left portion so as to be allowed to pass between the intermediate transfer member 1 and the pressure roller 11 toward the right portion.

The printing operation to be performed by the thus-structured thermal transfer printer 8 according to this embodiment will now be described with reference to FIG. 2.

When the printing operation of the thermal transfer printer 8 according to this embodiment has been started, the ink ribbon 10 and the intermediate transfer member 1 are pressed against the thermal head 6. Simultaneously, the heater 9 disposed in the intermediate transfer member 1 heats the intermediate transfer member 1 to a level at which the ink on the ink ribbon 10 cannot be melted. In accordance with information about the image to be printed, the heating devices (not shown) of the thermal head 6 selectively generate heat in the foregoing state. Thus, the ink on the ink ribbon 10 is softened or melted so that the ink is transferred to the surface of the transfer layer 3 of the intermediate transfer member 1 so as to be primarily maintained. Thus, the ink image 12, called a primarily recorded image, is formed.

Rotation of the intermediate transfer member 1 into the direction indicated by an arrow G shown in FIG. 2 causes the ink image 12 to be sequentially formed on the surface of the intermediate transfer member 1.

The ink ribbon 10 is, by a conveyance mechanism (not shown) for conveying the ink ribbon 10 by a frictional operation between the intermediate transfer member 1 and the ink ribbon 10 when the intermediate transfer member 1 is rotated, sequentially wound in the direction indicated by the arrow C shown in FIG. 2.

The speed of winding of the ink ribbon 10, that is moved into the direction indicated by the arrow C, is changed depending upon the radius of winding around a winding member indicated to the left portion of FIG. 2. Therefore, the speed, at which the ink ribbon 10 is wound, is set to be somewhat higher than the rotational speed of the intermediate transfer member 1 indicated by the arrow G shown in FIG. 2. The difference in the speed can be absorbed by a slip mechanism provided for a conveyance mechanism (both are not shown) for winding the ink ribbon 10.

Then, the pressure roller 11 is moved in a direction indicated by an arrow D shown in FIG. 2, and the heater 9 disposed in the intermediate transfer member 1 is heated in a state where the printing medium 7 is pressed against the ink image 12. As a result, the rotation of the intermediate transfer member 1 conveying the printing medium 7 in a direction indicated by the arrow F shown in FIG. 2, the pressure supplied from the pressure roller 11 and the heat generated by the heater 9 cause the ink image 12 written on the surface of the intermediate transfer member 1 to be sequentially again transferred from the intermediate transfer member 1 to the printing medium 7. Thus, the ink image 12 is printed on the printing medium 7.

After all ink images 12 have been printed on to the printing medium 7 (that is, after the printing process has been completed), the pressure roller 11 is moved in a direction indicated by an arrow E shown in FIG. 2 so as to be separated from the intermediate transfer member 1 and the printing medium 7 is discharged.

If a color printing operation is performed by using the thermal transfer printer 8 according to this embodiment, a full-color ink ribbon (not shown) having a plurality of inks is used and the foregoing printing process is repeated plural times to correspond to the colors of the inks. Thus, plural color inks are overlapped to perform color printing.

That is, in a case where a full-color ink ribbon having three color tones, that is Y (yellow), M (magenta) and C (cyan), is used, the printing operation is repeated three times, whereas in a case where a full-color ink ribbon having four color tones, that is, Y, M, C and Bk (black), is used, the printing operation is repeated four times.

When the color printing operation is performed as described above, the printing process is repeated to correspond to the number of the colors of the inks. Therefore, the printing medium 7 is caused to perform back feed in a direction opposing the direction indicated by the arrow F shown in FIG. 2, and as well as the thermal head 6 is moved in the direction indicated by an arrow B shown in FIG. 2 so that the state of close contact between the thermal head 6 and the intermediate transfer member 1 is suspended. In the foregoing state, the color ink ribbon is moved in the direction indicated by the arrow C shown in FIG. 2 so as to set the leading portion of the next color ink to perform the printing process for the next color.

After the printing process corresponding to all colors has been completed, the pressure roller 11 is moved in the direction indicated by the arrow E shown in FIG. 2, followed by being separated from the intermediate transfer member 1 so that the printing medium 7 is discharged.

When the printing medium 7 is caused to perform back feed at the time of performing the color printing process, the structure according to this embodiment is arranged such that the printing medium 7 is caused to perform back feed in a state where the pressure roller 11 maintains the same state as that in the printing process. Another structure may be employed in which the force of the pressure roller 11 for pressing the intermediate transfer member 1 is reduced at the time of the back feed of the printing medium 7. The back feed of the printing medium 7 at the time of performing the color printing operation may be performed by an exclusive paper feeding mechanism.

A second embodiment of the intermediate transfer member for the thermal transfer printer according to the present invention will now be described with reference to FIG. 3.

Figure 3:
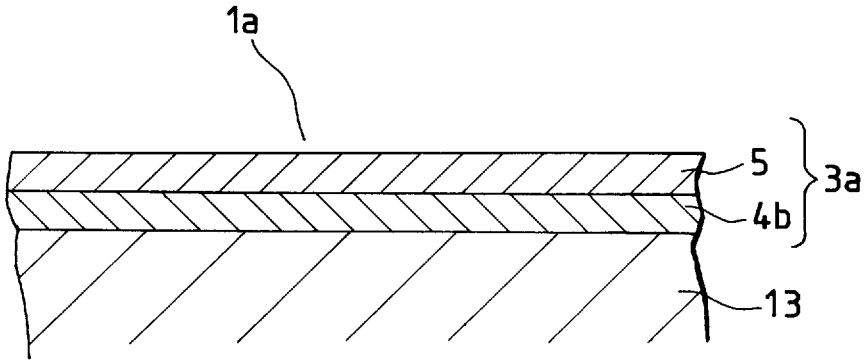
FIG. 3 is a schematic view showing a second embodiment of an intermediate transfer member for a thermal transfer printer according to the present invention.

FIG. 3 is a schematic view showing the second embodiment of the intermediate transfer member for the thermal transfer printer according to the present invention.

An intermediate transfer member 1*a* according to this embodiment is formed into a belt-like shape in which the outer surface of an endless metal belt or a belt base 13 comprising a seamless film made of polyimide or the like is covered with a transfer layer 3*a*. Experiments resulted in obtaining the optimum shape for the transfer layer 3*a*, which was in the form of a two-layer structure comprising an intermediate elastic layer 4*b* and a surface elastic layer 5 formed in this sequential order when viewed from the outer surface of the endless belt base 13.

The intermediate transfer member 1*a* having the foregoing structure and according to this embodiment will attain a similar effect obtainable from the intermediate transfer member 1 according to the first embodiment.

A thermal transfer printer 8*a* comprising the intermediate transfer member 1*a* according to this embodiment will now be described with reference to FIG. 4.

Figure 4:
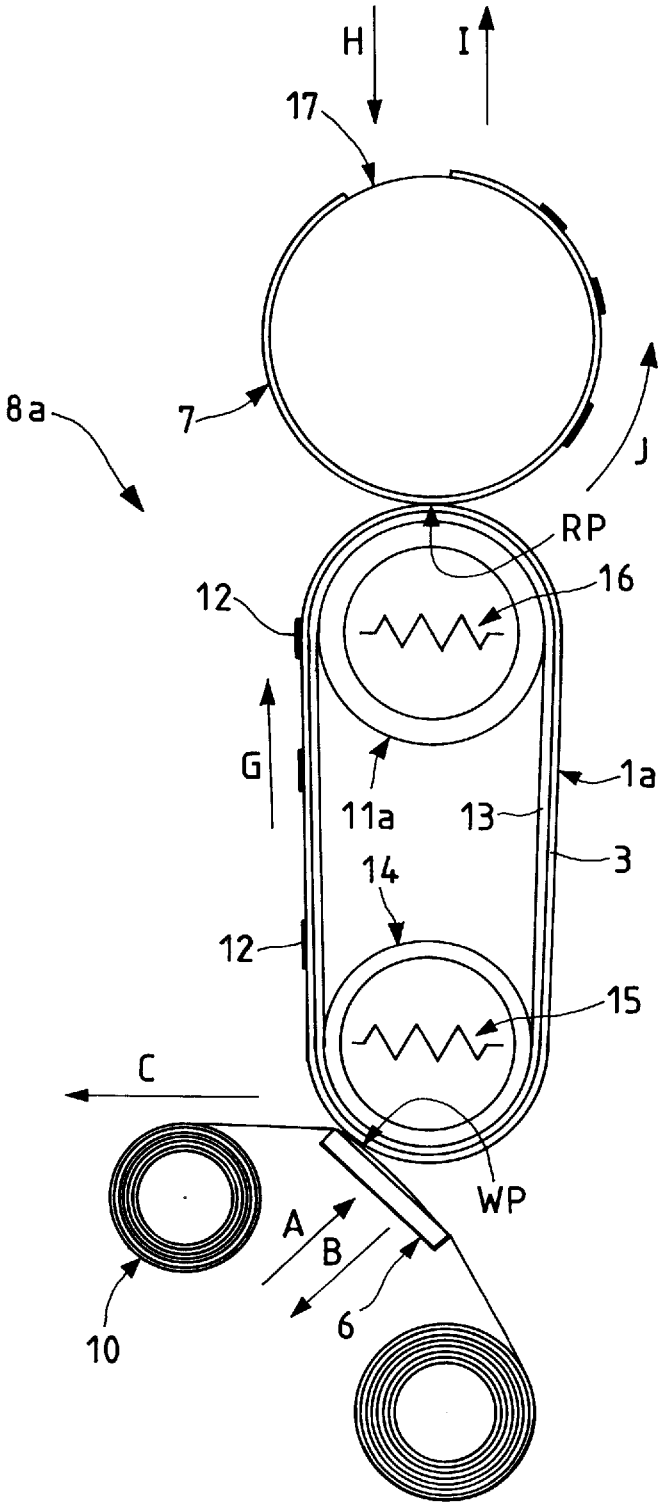
FIG. 4 is a diagram showing an essential portion of the structure of an embodiment of a thermal transfer printer comprising the intermediate transfer member for a thermal transfer printer according to a second embodiment of the present invention.

FIG. 4 is a diagram showing an essential portion of the structure of an embodiment of the thermal transfer printer comprising the intermediate transfer member 1*a* according to the second embodiment of the present invention.

As shown in FIG. 4, the thermal transfer printer 8*a* according to this embodiment comprises a pressure roller 11*a* and a platen roller 14 that are disposed apart from each other in the vertical direction, wherein either roller acts as a drive roller and a residual roller acts as a follower roller. To be in contact with the outer surfaces of the pressure roller 11*a* and the platen roller 14, the intermediate transfer member 1*a* in the form of the endless belt is wound around the rollers 11*a* and 14.

The platen roller 14 is made of a metal material formed into a substantially cylindrical shape, the platen roller 14 including a heater 15. Note that the platen roller 14 may have a structure having the outer surface that is covered with rubber. The platen roller 14 is not limited to the structure according to this embodiment.

The temperature of the surface of the platen roller 14 is controlled to be raised to about 50° C.

The pressure roller 11*a* is formed similarly to the pressure roller 11 according to the first embodiment, the pressure roller 11*a* including a heater 16 so that the temperature of the surface of the pressure roller 11*a* is controlled to be raised to about 70° C. to 75° C.

Above the pressure roller 11*a*, there is disposed a drum 17 around which the printing medium 7 can be wound. The drum 17 has, on the outer surface thereof, a damper (not shown) serving as a fixing means that can be opened/closed by a drive source (not shown). The damper secures, to the surface of the drum 17, the leading end of the printing medium 7 in the direction of the movement of the printing medium 7. The drum 17 has a circumferential length that is longer than the length of the printing medium 7 so as to wind the printing medium 7 around thereto. In a case where the printing medium 7 is, for example, letter-size plain paper, the diameter of the drum 17 is determined to be 100 mm or longer. The drum 17 can be, by a drive mechanism (not shown), brought into contact with the pressure roller 11*a* and separated from the same as indicated by arrows H and I shown in FIG. 4. The position, at which the drum 17 and the pressure roller 11*a* are brought into contact with each other, is re-transferring position RP, at which the ink image 12 written on the intermediate transfer member 1*a* is again transferred to the printing medium 7.

At a lower left position from the platen roller 14, there is disposed a thermal head 6 similar to that according to the first embodiment. The thermal head 6 can be, by a drive mechanism (not shown), brought into contact with the platen roller 14 and separated from the same as indicated by arrows A and B shown in FIG. 4. The position, at which the thermal head 6 and the platen roller 14 are brought into contact with each other, is transferring position WP, at which ink on the ink ribbon 10 is written on to the intermediate transfer member 1*a*.

Between the intermediate transfer member 1*a* and the thermal head 6, there is supplied the ink ribbon 10 similarly to the first embodiment.

Then, the printing operation of the thermal transfer printer 8*a* having the foregoing structure and according to this embodiment will now be described with reference to FIG. 4.

When the printing operation of the thermal transfer printer 8*a* according to this embodiment has been started, initially the ink ribbon 10, the intermediate transfer member 1*a* and the platen roller 14 are pressed by the thermal head 6. Simultaneously, the heater 15 disposed in the platen roller 14 heats the intermediate transfer member 1*a* to a level that does not melt the ink on the ink ribbon 10. In the foregoing state, in accordance with information about the image to be printed, the heating devices (not shown) of the thermal head 6 are selectively operated to generate heat. Thus, the ink on the ink ribbon 10 is softened or melted so that the ink is transferred to the surface of the transfer layer 3 of the intermediate transfer member 1*a* so as to be primarily maintained. Thus, an ink image 12 called a primarily recorded image is formed.

The rotation of the intermediate transfer member 1*a* in the direction indicated by an arrow G shown in FIG. 4 causes the ink image 12 to be sequentially formed on the surface of the intermediate transfer member 1*a*.

The ink ribbon 10 is, by a conveyance mechanism (not shown) for conveying the ink ribbon 10 by a frictional operation between the intermediate transfer member 1*a* and the ink ribbon 10 when the intermediate transfer member 1*a* is rotated, sequentially wound into the direction indicated by an arrow C shown in FIG. 4.

The speed of winding of the ink ribbon 10, that is moved into the direction indicated by the arrow C, is changed depending upon the radius of winding around a winding member indicated to the left portion of FIG. 4. Therefore, the speed, at which the ink ribbon 10 is wound, is set to be somewhat higher than the rotational speed of the intermediate transfer member 1*a* indicated by the arrow G shown in FIG. 4. The difference in the speed can be absorbed by a slip mechanism provided for a conveyance mechanism (both are not shown) for winding the ink ribbon 10.

As for the ink image 12 written on the surface of the intermediate transfer member 1*a*, the printing medium 7 is secured to the outer surface of the intermediate transfer member 1*a* as the intermediate transfer member 1*a* is rotated. The pressure from the drum 17 moved in a direction indicated by an arrow H shown in FIG. 4 and heat transmitted from the heater 16 disposed in the pressure roller 11*a* sequentially re-transfer the ink image 12 from the intermediate transfer member 1*a* to the printing medium 7 so that printing on to the printing medium 7 is performed.

After printing of all ink images 12 on to the printing medium 7 has been completed, the drum 17 is moved into a direction indicated by an arrow I shown in FIG. 4 so as to be separated from the intermediate transfer member 1*a*. Then, the printing medium 7 is separated from the surface of the drum 17 so as to be discharged.

Note that the color printing operation using the thermal transfer printer 8*a* according to this embodiment is performed in a method that is different from the method in the case where the thermal transfer printer 8 according to the first embodiment is used, in which the printing medium 7 is not caused to perform back feed but the drum is always rotated in a predetermined direction indicated by an arrow J shown in FIG. 4 to enable the printing process to be repeated. Therefore, the printing speed can be raised as compared with that realized by the thermal transfer printer 8 according to the first embodiment.

Then, experiments were performed to evaluate the re-transferring performance of the intermediate transfer member 1*a* according to the foregoing embodiment.

In the experiments for evaluating the re-transferring characteristic, the intermediate transfer member 1*a* was mounted on the thermal transfer printer 8*a*, the temperature of the surface of the platen roller 14 was set to 50° C., the temperature of the surface (the transferring temperature) of the pressure roller 11*a* was, every 5° C., changed from 50° C. to 85° C. in 8 steps, and the load (the transferring pressure) at the time of the re-transferring process was, every 1 kg/cm, changed from 1 kg/cm to 3 kg/cm in three steps so that leaving of ink on the surface of the intermediate transfer member 1*a* after the ink image has been again transferred was evaluated with marks ○ (no ink was left) and x (ink was left). The results of the evaluation are shown in Table 1.

TABLE 1

| Transferring | Transferring Temperature (°C.) | | | | | | | |
|---|---|---|---|---|---|---|---|---|
| Pressure (kg/cm) | 50 | 55 | 60 | 65 | 70 | 75 | 80 | 85 |
| 3.0 | o | o | o | o | o | o | o | o |
| 2.0 | o | o | o | o | o | o | o | o |
| 1.0 | x | x | x | o | o | o | o | o |

criteria:
x ink was left on the intermediate transfer member after the re-transferring process
o no ink was left on the intermediate transfer member after the re-transferring process To perform a comparison, the re-transferring characteristic of the following intermediate transfer members was evaluated.

Comparative Example 1

The outer surface of an endless belt base 13 similar to that according to the second embodiment comprised an intermediate transfer member formed by a surface elastic layer made of silicon rubber formed by hardening composition (I) and containing an inorganic filler having a thickness of 130 μm, composition (I) containing, blended therein, (a) Alkenyl-Group-Containing Organopolysiloxane 100 parts by weight of dimethylpolysiloxane, the viscosity of which was 10,000 cps at 25° C., and which had the two terminals that were sealed by dimethylvinylsilyl groups;

(b) Organohydrogenpolysiloxane 1.6 parts by weight of organohydrogenpolysiloxane expressed by average composition formula (4) below:

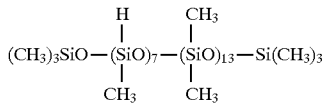

$$(CH_3)_3SiO-(\underset{\underset{CH_3}{|}}{\overset{\overset{H}{|}}{Si}}O)_7-(\underset{\underset{CH_3}{|}}{\overset{\overset{CH_3}{|}}{Si}}O)_{13}-Si(CH_3)_3 \quad (4)$$

(c) Surface Treatment Reinforcing Silica by 25 parts by weight;

(d) Non-Reactive Organopolysiloxane 2.0 parts by weight of non-reactive organopolysiloxane, which was methylphenylpolysiloxane, the viscosity of which was 1000 cps at 25° C., which had the two terminals that were sealed by trimethylsilyl groups, and which contained diphenylsiloxane units by 6 mol %; and (e) Hydrosilylated Reactive Catalyst 0.5 part by weight of 2 wt % alcohol solution of chloroplatinic acid. The results of evaluation of the foregoing intermediate transfer member are shown in Table 2.

TABLE 2

| Transferring | Transferring Temperature (°C.) | | | | | | | |
|---|---|---|---|---|---|---|---|---|
| Pressure (kg/cm) | 50 | 55 | 60 | 65 | 70 | 75 | 80 | 85 |
| 3.0 | x | x | x | x | x | o | o | x |
| 2.0 | x | x | x | x | x | x | x | x |
| 1.0 | x | x | x | x | x | x | x | x |

criteria:
x ink was left on the intermediate transfer member after the re-transferring process
o no ink was left on the intermediate transfer member after the re-transferring process Comparative Example 2

The outer surface of an endless belt base 13 similar to that according to the second embodiment comprised an intermediate transfer member formed by a surface elastic layer made of silicon rubber formed by hardening composition (II) and containing no inorganic filler having a thickness of 130 μm, composition (II) containing, blended therein, (a) Alkenyl-Group-Containing Organopolysiloxane 100 parts by weight of dimethylpolysiloxane, the viscosity of which was 10,000 cps at 25° C., and which had the two terminals that were sealed by dimethylvinylsilyl groups;

(b) Organohydrogenpolysiloxane 1.6 parts by weight of organohydrogenpolysiloxane expressed by average composition formula (4) below:

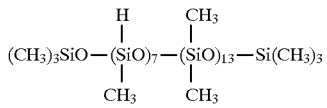

$$(CH_3)_3SiO-(\underset{\underset{CH_3}{|}}{\overset{\overset{H}{|}}{Si}}O)_7-(\underset{\underset{CH_3}{|}}{\overset{\overset{CH_3}{|}}{Si}}O)_{13}-Si(CH_3)_3 \quad (4)$$

(c) Hydrosilylated Reactive Catalyst 0.5 part by weight of 2 wt % alcohol solution of chloroplatinic acid. The results of evaluation of the foregoing intermediate transfer member are shown in Table 3.

TABLE 3

| Transferring | Transferring Temperature (°C.) | | | | | | | |
|---|---|---|---|---|---|---|---|---|
| Pressure (kg/cm) | 50 | 55 | 60 | 65 | 70 | 75 | 80 | 85 |
| 3.0 | x | x | o | o | o | o | o | x |
| 2.0 | x | x | x | x | o | o | o | x |
| 1.0 | x | x | x | x | x | x | x | x |

criteria:
x ink was left on the intermediate transfer member after the re-transferring process
o no ink was left on the intermediate transfer member after the re-transferring process

Comparative Example 3

The outer surface of an endless belt base 13 similar to that according to the second embodiment comprised an intermediate transfer member formed by a surface elastic layer made of silicon rubber formed by hardening composition (III) and containing no inorganic filler having a thickness of 130 μm, composition (III) containing, blended therein, (a) Composition (II) according to Comparative Example 2 by 100 parts by weight; and (b) Non-reactive organopolysiloxane 10 parts by weight of dimethylpolysiloxane, the viscosity of which was 1000 cps at 25° C., and which had the two terminals that were sealed by trimethylsilyl groups. The results of evaluation of the foregoing intermediate transfer member are shown in Table 4.

TABLE 4

| Transferring | Transferring Temperature (°C.) | | | | | | | |
|---|---|---|---|---|---|---|---|---|
| Pressure (kg/cm) | 50 | 55 | 60 | 65 | 70 | 75 | 80 | 85 |
| 3.0 | x | x | x | x | o | o | o | o |
| 2.0 | x | x | x | x | x | o | o | o |
| 1.0 | x | x | x | x | x | x | x | x |

criteria:
x ink was left on the intermediate transfer member after the re-transferring process
o no ink was left on the intermediate transfer member after the re-transferring process

Results of Evaluation

As shown in Table 1, the intermediate transfer member 1*a* of the thermal transfer printer according to the embodiment of the present invention exhibited an excellent re-transferring characteristic over the entire transferring temperature range when the transferring pressure was set to be 2 kg/cm. Furthermore, it exhibited an excellent re-transferring characteristic even if the transferring pressure was set to be 1 kg/cm depending upon the transferring temperature.

That is, each of the intermediate transfer members 1 and 1*a* of the thermal transfer printers according to the embodiments of the present invention enables the allowable limits for the transferring temperature and the transferring pressure to be widened. Therefore, the ink writing characteristic at the time of the recording process, in which an ink image is written, and the re-transferring characteristic at the time of the re-transferring process, in which the ink image is again transferred on to the printing medium, can be reliably maintained for a long time. Furthermore, an ink image exhibiting excellent image quality can be formed on a printing medium, such as plain paper or bond paper. Since the load (the transferring pressure) at the time of the re-transferring process can be reduced, the size of each of the thermal transfer printer 8 and 8*a* using the corresponding intermediate transfer member 1 or 1*a* according to the embodiment of the present invention can be reduced and required strength of the same can be weakened. Therefore, the size and cost of each of the thermal transfer printers 8 and 8*a* can reliably be reduced.

As contrasted to this, Comparative Examples 1 to 3 exhibited an excellent re-transferring characteristic only in a narrow transferring temperature range even if the transferring pressure was set to 3 kg/cm.

That is, Comparative Examples 1 to 3 provided unsatisfactorily narrow allowable ranges for the transferring temperature and the transferring pressure. Therefore, the ink writing characteristic at the time of the recording process, in which an ink image is written, and the re-transferring characteristic at the time of the re-transferring process, in which the ink image is again transferred on to the printing medium, are unsatisfactory, and ink images exhibiting excellent image quality cannot be printed on the printing medium, such as plain paper or bond paper.

Note that the present invention is not limited to each of the embodiments, but it may be changed as the need arises.

As described above, the intermediate transfer member for the thermal transfer printer according to the present invention is able to, for a long time, reliably maintain the ink writing characteristic at the time of the recording process, in which an ink image is written, and the re-transferring characteristic at the time of the re-transferring process, in which the ink image is again transferred on to the printing medium. Furthermore, ink images exhibiting excellent image quality can be formed on printing mediums, such as plain paper or bond paper.

The intermediate transfer member for the thermal transfer printer according to the present invention is able to reduce the load at the time of the re-transferring process so that the size of the thermal transfer printer using the intermediate transfer member according to the present invention is reduced and the required strength of the same is weakened. Therefore, excellent effects can be obtained in that the size and cost of the thermal transfer printer can reliably be reduced.

Although the invention has been described in its preferred form with a certain degree of particularity, it is understood that the present disclosure of the preferred form can be changed in the details of construction and the combination and arrangement of parts may be resorted to without departing from the spirit and the scope of the invention as hereinafter claimed.

What is claimed is:

1. An intermediate transfer member for a thermal transfer printer adapted to transfer an ink image from an ink ribbon onto the intermediate transfer member and to subsequently transfer the ink image from the intermediate transfer member onto a printing medium, the intermediate transfer member comprising:

a transfer layer having a surface layer of silicon rubber containing:

(a) alkenyl-group-containing organopolysiloxane;

(b) organohydrogenpolysiloxane (c) non-reactive organopolysiloxane expressed by the following formula (1):

$$R^1-(\underset{\underset{R^2}{|}}{\overset{\overset{R^2}{|}}{SiO}})_n-\underset{\underset{R^2}{|}}{\overset{\overset{R^2}{|}}{Si}}-R^1 \quad (1)$$

where $R^1$ is one of a monovalent hydrocarbon group having no aliphatic unsaturated group and a hydroxyl group, $R^2$ includes one or more of methyl groups and phenyl groups, and where 1 mol % to 30 mol % of each molecule comprises phenyl groups; and (d) a hydrosilylated reactive catalyst, wherein said silicon rubber contains no inorganic filler.

2. An intermediate transfer member for a thermal transfer printer according to claim 1, wherein the integer n of formula (1) is selected to produce a viscosity at 25° C. of 100 cps to 100,000 cps.

3. An intermediate transfer member for a thermal transfer printer according to claim 2, wherein said (b) organohydrogenpolysiloxane is expressed by the following formula (2):

$$R^3R^4{}_2SiO-(\underset{\underset{R^5}{|}}{\overset{\overset{H}{|}}{Si}}O)_a-(\underset{\underset{R^5}{|}}{\overset{\overset{R^5}{|}}{Si}}O)_b-SiR^4{}_2R^3 \quad (2)$$

where $R^3$ is one of a hydrogen atom and a monovalent hydrocarbon group having no aliphatic unsaturated group, each of $R^4$ and $R^5$ is a monovalent hydrocarbon group having no aliphatic unsaturated group, a is an integer not less than 3, b is an integer not less than 0, and 0.7 a/(a+b) 1.0.

4. An intermediate transfer member for a thermal transfer printer according to claim 2, wherein said silicon rubber of said surface layer has a thickness of 5 $\mu$m to 200 $\mu$m and rubber hardness of 15 to 50 (JIS A).

5. An intermediate transfer member for a thermal transfer printer according to claim 2, wherein said transfer layer further comprises a rubber elastic layer in the form of n (n=1, 2) layers with the surface layer formed thereon, and wherein said elastic layer in the form of n layers has a thickness of 3.0 mm or thinner and rubber hardness of 10 to 70 (JIS A).

6. An intermediate transfer member for a thermal transfer printer according to claim 2, wherein said transfer layer comprises a three-layer structure consisting of two elastic layers and said surface layer, wherein a first layer of said elastic layers has a thickness of 2.8 mm or thinner and rubber hardness of 15 to 70 (JIS A), and a second layer of said elastic layers located between said first layer and said surface layer has a thickness of 200 $\mu$m or thinner and rubber hardness of 10 to 35 (JIS A).

7. An intermediate transfer member according to claim 1 wherein said transfer member further comprises a metallic roll, said transfer layer being formed on said metallic roll.

8. An intermediate transfer member according to claim 1 wherein said intermediate transfer member comprises a belt, said transfer layer being formed on said belt.

9. An intermediate transfer member for a thermal transfer printer according to claim 1, wherein said (b) organohydrogenpolysiloxane is expressed by the following formula (2):

$$R^3R^4{}_2SiO-(\underset{\underset{R^5}{|}}{\overset{\overset{H}{|}}{Si}}O)_a-(\underset{\underset{R^5}{|}}{\overset{\overset{R^5}{|}}{Si}}O)_b-SiR^4{}_2R^3 \quad (2)$$

where $R^3$ is one of a hydrogen atom and a monovalent hydrocarbon group having no aliphatic unsaturated group, each of $R^4$ and $R^5$ is a monovalent hydrocarbon group having no aliphatic unsaturated group, a is an integer not less than 3, b is an integer not less than 0, and 0.7 a/(a+b) 1.0.

10. An intermediate transfer member for a thermal transfer printer according to claim 9, wherein said silicon rubber of said surface layer has a thickness of 5 $\mu$m to 200 $\mu$m and rubber hardness of 15 to 50 (JIS A).

11. An intermediate transfer member for a thermal transfer printer according to claim 9, wherein said transfer layer further comprises a rubber elastic layer in the form of n (n=1, 2) layers with the surface layer formed thereon, and wherein said elastic layer in the form of n layers has a thickness of 3.0 mm or thinner and rubber hardness of 10 to 70 (JIS A).

12. An intermediate transfer member for a thermal transfer printer according to claim 9, wherein said transfer layer comprises a three-layer structure consisting of two elastic layers and said surface layer, wherein a first layer of said elastic layers has a thickness of 2.8 mm or thinner and rubber hardness of 15 to 70 (JIS A), and a second layer of said elastic layers located between said first layer and said surface layer has a thickness of 200 $\mu$m or thinner and rubber hardness of 10 to 35 (JIS A).

13. An intermediate transfer member for a thermal transfer printer according to claim 1, wherein said silicon rubber of said surface layer has a thickness of 5 $\mu$m to 200 $\mu$m and rubber hardness of 15 to 50 (JIS A).

14. An intermediate transfer member for a thermal transfer printer according to claim 13, wherein said transfer layer further comprises a rubber elastic layer in the form of n (n=1, 2) layers with the surface layer formed thereon, and wherein said elastic layer in the form of n layers has a thickness of 3.0 mm or thinner and rubber hardness of 10 to 70 (JIS A).

15. An intermediate transfer member for a thermal transfer printer according to claim 13, wherein said transfer layer comprises a three-layer structure consisting of two elastic layers and said surface layer, wherein a first layer of said elastic layers has a thickness of 2.8 mm or thinner and rubber hardness of 15 to 70 (JIS A), and a second layer of said elastic layers located between said first layer and said surface layer has a thickness of 200 $\mu$m or thinner and rubber hardness of 10 to 35 (JIS A).

16. An intermediate transfer member for a thermal transfer printer according to claim 1, wherein said transfer layer further comprises a rubber elastic layer in the form of n (n=1, 2) layers with the surface layer formed thereon, and wherein said elastic layer in the form of n layers has a thickness of 3.0 mm or thinner and rubber hardness of 10 to 70 (JIS A).

17. An intermediate transfer member for a thermal transfer printer according to claim 1, wherein said transfer layer comprises a three-layer structure consisting of two elastic layers and said surface layer, wherein a first layer of said elastic layers has a thickness of 2.8 mm or thinner and rubber hardness of 15 to 70 (JIS A), and a second layer of said elastic layers located between said first layer and said surface layer has a thickness of 200 $\mu$m or thinner and rubber hardness of 10 to 35 (JIS A).

18. An intermediate transfer member for a thermal transfer printer according to claim 17, wherein said first layer of said elastic layers comprises silicon rubber having a thickness of 2.8 mm or thinner and rubber hardness of 15 to 70 (JIS A).

19. An intermediate transfer member for a thermal transfer printer according to claim 17, wherein said second layer of said elastic layers comprises silicon rubber having a thickness of 200 $\mu$m or thinner and rubber hardness of 10 to 35 (JIS A), said silicon rubber containing no inorganic filler.

20. An intermediate transfer member for a thermal transfer printer according to claim 17, wherein said second layer of said elastic layers comprises silicon rubber having a thickness of 200 $\mu$m or thinner and rubber hardness of 10 to 35 (JIS A), said silicon rubber containing no inorganic filler.

* * * * *